US006866183B2

(12) United States Patent
Purcell

(10) Patent No.: US 6,866,183 B2
(45) Date of Patent: Mar. 15, 2005

(54) ADJUSTABLE ENVELOPE

(75) Inventor: Douglas K. Purcell, Chicopee, MA (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 10/323,078

(22) Filed: Dec. 20, 2002

(65) Prior Publication Data

US 2003/0173395 A1 Sep. 18, 2003

Related U.S. Application Data

(63) Continuation-in-part of application No. 09/929,062, filed on Aug. 15, 2001, now abandoned.

(51) Int. Cl.[7] ..... B65D 27/00
(52) U.S. Cl. ..... 229/68.1; 229/75; 229/928
(58) Field of Search ..... 229/68.1, 75, 87.18, 229/87.19, 928

(56) References Cited

U.S. PATENT DOCUMENTS

| | | | | | |
|---|---|---|---|---|---|
| 188,299 | A | * | 3/1877 | Marshall | 229/75 |
| 192,363 | A | * | 6/1877 | Christey | 229/75 |
| 646,638 | A | * | 4/1900 | Cutler | 229/75 |
| 926,025 | A | * | 6/1909 | Shaffer | 229/84 |
| 1,010,282 | A | | 11/1911 | Low | |
| 1,042,488 | A | * | 10/1912 | Shaffer | 229/67.3 |
| 1,194,440 | A | * | 8/1916 | Swortfiguer | 229/67.3 |
| 2,364,297 | A | * | 12/1944 | James | 229/87.19 |
| 2,945,616 | A | * | 7/1960 | Normandin | 229/67.3 |
| 2,945,617 | A | * | 7/1960 | Normandin | 229/67.3 |
| 3,063,618 | A | * | 11/1962 | Berkowitz | 229/67.3 |
| 3,144,979 | A | * | 8/1964 | Young | 229/101 |
| 3,414,185 | A | * | 12/1968 | Young | 229/75 |
| 3,552,640 | A | | 1/1971 | Young | |
| 3,648,923 | A | * | 3/1972 | Young | 229/75 |
| 3,817,445 | A | | 6/1974 | Greason | |
| D250,590 | S | * | 12/1978 | Cohn et al. | D19/3 |
| 5,398,866 | A | | 3/1995 | Bluemle | |

* cited by examiner

*Primary Examiner*—Jes F. Pascua
(74) *Attorney, Agent, or Firm*—Daniel B. Reece, IV; Terry B. McDaniel

(57) ABSTRACT

The invention teaches an envelope with an adjustable dimension to accommodate inserts of varying size.

12 Claims, 3 Drawing Sheets

ADJUSTABLE ENVELOPE

CROSS REFERENCE TO RELATED APPLICATIONS

The present application is a continuation in part application of U.S. application Ser. No. 09/929,062 filed on Aug. 15, 2001, which is abandoned.

TECHNICAL FIELD OF THE INVENTION

This invention is directed to an envelope blank and method of forming an adjustable envelope.

BACKGROUND OF THE INVENTION

Mailing operations such as bulk mail advertising and delivery of account notices are used by merchants, financial institutions, and others to communicate with existing and prospective customers. Often pre-printed "return" envelopes are included in the mailing for the convenience of customers. Sometimes customer's use commercial checks that are larger than the return envelopes included by the merchants. In such cases, the checks must be folded to fit in the return envelope or the customer must use his own envelope.

An alternative is for the merchant to provide the customer with an adjustable envelope that can be adjusted to a larger size to hold the unfolded check. Several envelopes have been developed that have adjustable sizes. U.S. Pat. No. 1,010,282 issued to Low discloses an envelope that can be adjusted to different sizes to accommodate multiple documents. The envelope body has auxiliary inner and outer closing flaps secured by glue or other means at its ends. The flaps are folded inwardly and superimposed over the envelope body. The outer closing flaps have cutaway portions with arranged tongues extending in the direction of the flap. The tongues are inserted into openings along the length of the flap to keep the envelope closed. U.S. Pat. No. 3,552,640 issued to Young relates to an envelope with pleated side flaps forming folded gussets that unfold to expand the envelope into a box-like configuration. U.S. Pat. No. 3,817,445 issued to Greason discloses an envelope that has two panels joined by an adhesive to form an expandable pocket. The expandable feature is provided by an accordion fold between the longitudinal edges of its two panels. U.S. Pat. No. 5,398,866 issued to Bluemle describes an envelope with pleated side flaps that form a box-like gusset for depth-wise expansion. The side flaps are constructed as side portions of one panel that are foldable longitudinally, with side tongues at the bottom ends. The bottom side tongues serve for closing and adhesively bonding the side flaps to the envelope bottom. The pleated or folded expansion means described in these patents have however been found to be bulky, thus creating difficulties in stacking and bulk packaging of the envelopes. The tongue closure means using are complex, expensive to manufacture, and difficult to use with automated mailing equipment.

What is needed is an adjustable envelope made from a blank that can easily be adjusted from a first size to a second size.

SUMMARY OF THE INVENTION

The invention teaches an adjustable envelope with a front panel, rear panel, closure panel, a first side flap, and a second side flap that is adjustable. The first side flap is secured to the rear panel, the second side flap is not. The envelope's size can be adjusted by manipulating the adjustable side flap of the envelope to a different dimension. The adjustable side flap has at least one fold line at least some distance from the front panel. In an exemplary use, a first user will include an adjustable envelope in a first shorter length as an insert in another envelope. The second user will adjust the length of the adjustable envelope to a second longer length to hold a larger item.

DETAILED DESCRIPTION OF THE INVENTION

Figure 1:
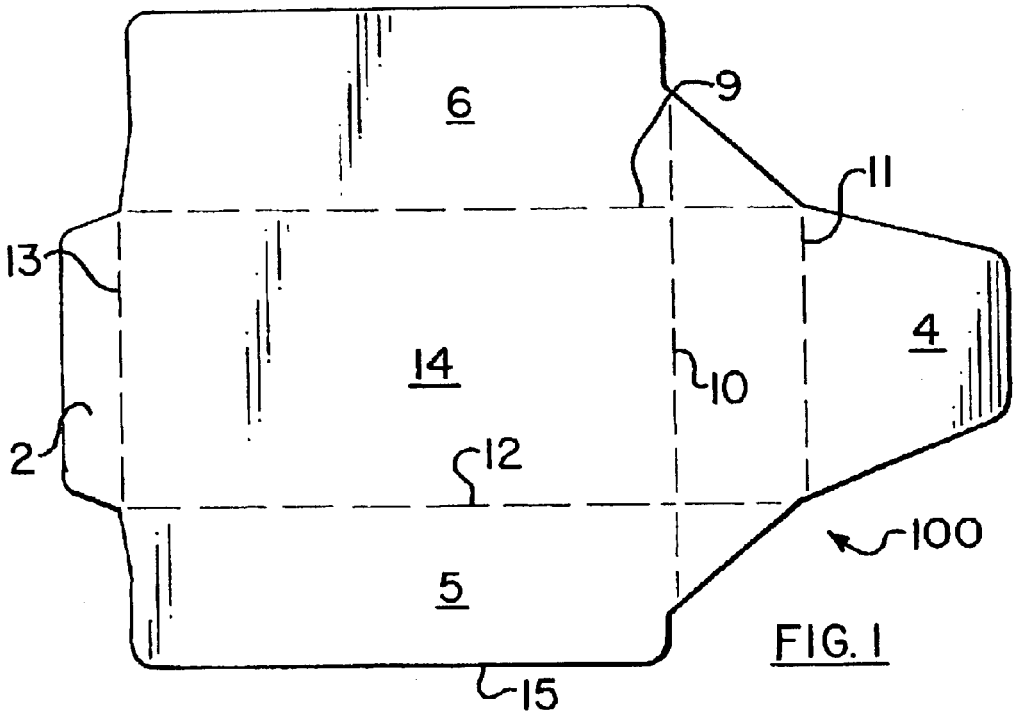
FIG. 1 illustrates an exemplary plan view of an envelope blank according to the invention.

FIG. 1 illustrates an exemplary envelope blank 100 according to the invention. Blank 100 is illustrated with a front panel 14 and two side flaps 2, 4 secured along fold lines 13, 10. Flap 2 is exemplary illustrated with a fixed length and flap 4 is illustrated with an adjustable length along fold line 11. A closure flap 6 and rear flap 5 are also secured to front panel 14 along fold lines 9, 12. Fold lines 9, 10, 11, 12, 13 are exemplary pre-scored to assist with folding blank 100 into an envelope.

Figure 2:
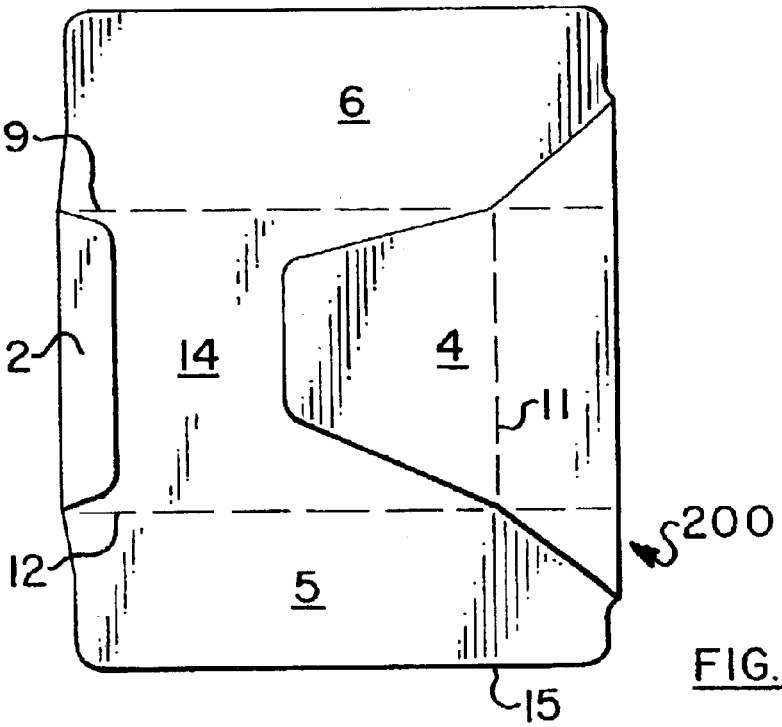
FIG. 2 illustrate the blank of FIG. 1 partially folded.
Figure 3:
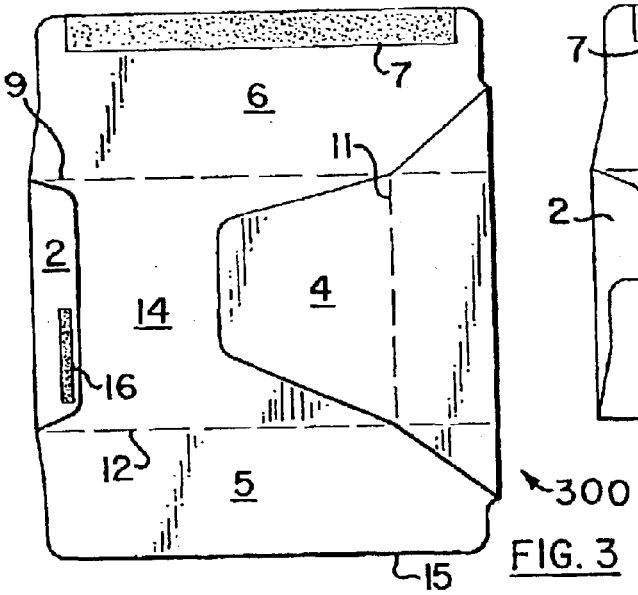
FIG. 3 illustrates the blank of FIG. 2 after adhesive regions are formed on the blank.
Figure 4:
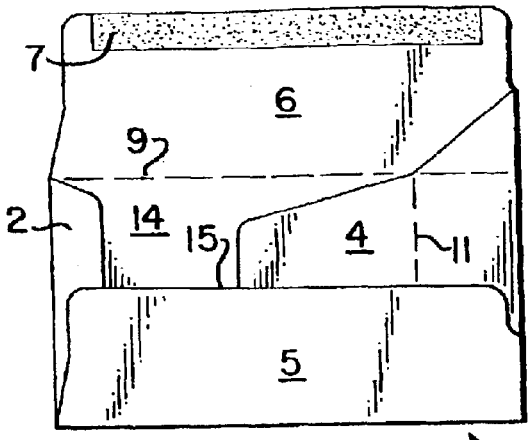
FIG. 4 illustrates a partially formed envelope from the blank of FIG. 3.

FIG. 2 illustrates a partially formed envelope blank 200. Side flaps 2, 4 are illustrated fold inwardly toward the front panel 14. FIG. 3 illustrates two adhesive regions 7, 16 formed on the blank 200. The two adhesive regions 7, 16 may be any suitable adhesive material such as a self-moistening or water-reactive gum, polymer or other glue substance. The adhesive regions should be located and dimensioned to provide suitable security for the envelope contents. FIG. 4 illustrates the envelope 400 with rear panel 5 folded and secured to side panel 2 along adhesive region 16. The rear panel 5 is not secured to side flap 4.

Figure 5:
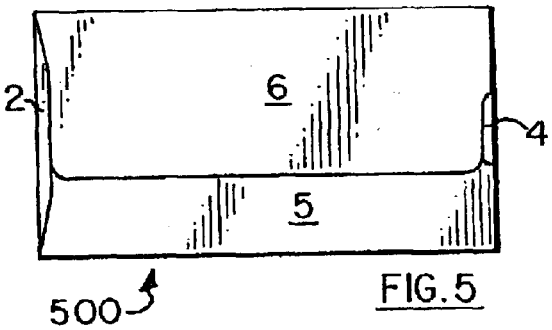
FIG. 5 illustrates a first length envelope.

FIG. 5 illustrates the envelope 500 with closure panel 6 folded over the side flaps 2, 4 and rear panel 5. Envelope 500 is illustrated with a first length. It is to be understood that for an exemplary use, the closure panel 6 will not be sealed to the rear panel 5.

Figure 6:
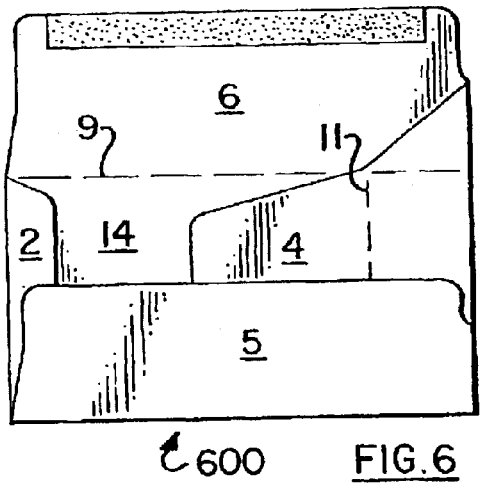
FIG. 6 illustrates the envelope of FIG. 5 partially unfolded.
Figure 7:
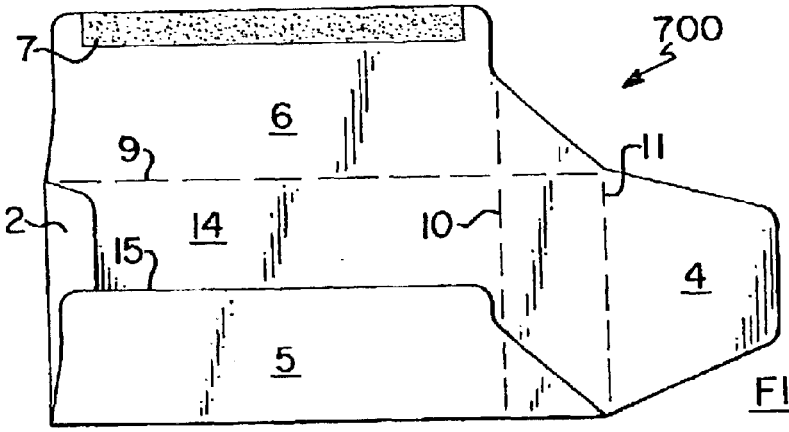
FIG. 7 illustrates the envelope of FIG. 6 after additional unfolding.
Figure 8:
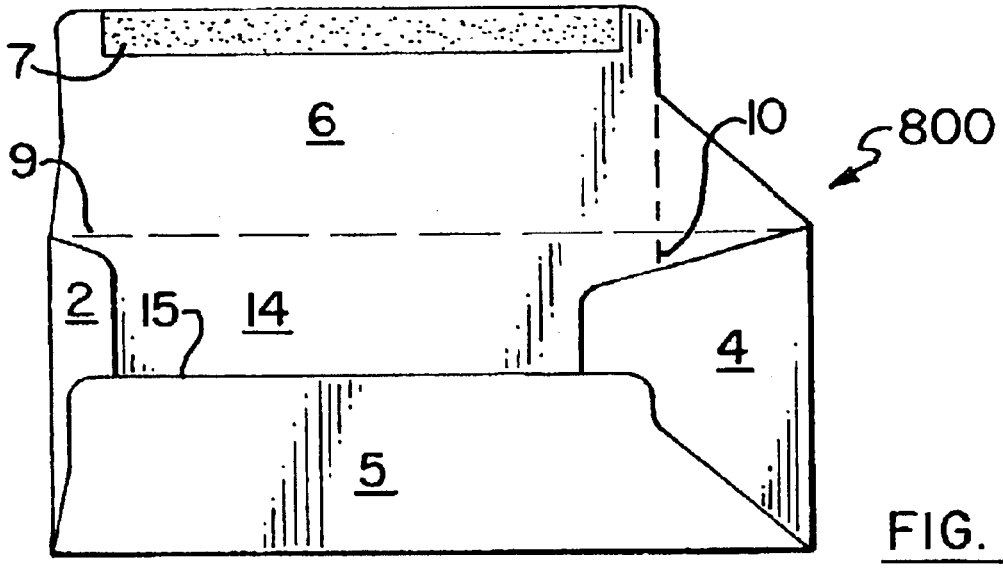
FIG. 8 illustrates a partially formed envelope of a second length.
Figure 9:
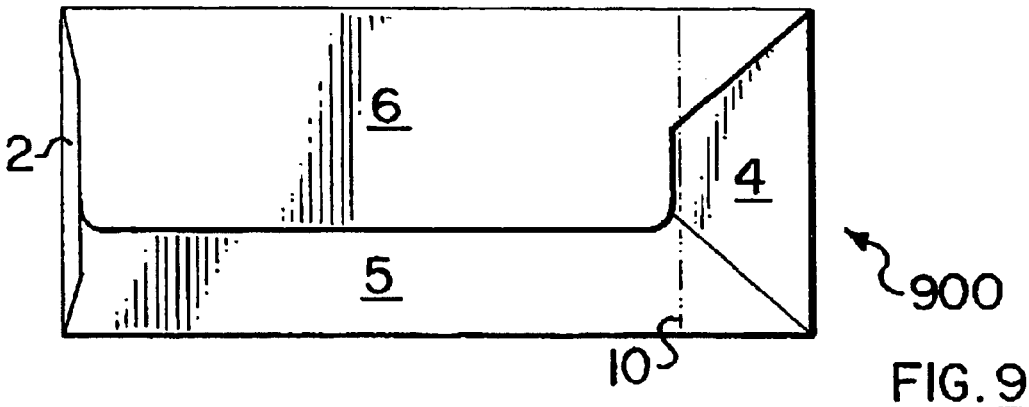
FIG. 9 illustrates a second length envelope.

FIGS. 6–9 will illustrate the steps to adjust envelope 500 to a second length (FIG. 9). FIG. 6 illustrates the envelope 600 after the closure panel 6 is folded up away from the side flaps 2, 4, and rear panel 5. FIG. 7 illustrates envelope 700 after side flap 4 is maneuvered out from under rear panel 5 and unfolded along fold line 10. FIG. 8 illustrates envelope 800 after side flap 4 is folded along fold line 11 and maneuvered under rear panel 5. Envelope 800 is illustrated as a longer envelope than that shown in FIG. 5. After the contents are placed in the envelope 800, closure flap 6 is secured over side flaps 2, 4 and closure flap 5 using adhesive region 7. Ideally, the dimensions of blank 100 are optimized to prevent the formation of gaps in either position. Also the design should be optimized to reduce tearing of the envelope during manufacturing and adjusting.

The envelope design of the invention provides an adjustable envelope that can be used for multiple mailing applications. Use of the envelope in a first, compact length allows it to be inserted inside another envelope mailer. The envelope may be folded with even overlaps to provide a relatively even thickness across all panels for packing and stacking in automated mailing operations. Thus, the problem of uneven and bulky stacking found with gusset envelopes having, for example, pleated or box folds is eliminated.

The adjustable design of the envelope allows automated bill processing at high speeds. If longer commercial sized checks are mailed flat, rather than folded to fit in a shorter envelope, the checking processing operation can be improved. Envelopes containing folded checks cannot be put through fast automatic extraction processes. However, envelopes containing unfolded checks, can be slit along three sides to send the check in one direction and the envelope remains in the other. The sliver cuts can be vacuumed away. Moreover, the envelope angles of the present invention can be optimized to enhance automation.

It is believed that the present invention includes many other embodiments that may not be described in detail, but would nonetheless be appreciated by those skilled in the art from the above disclosure. Accordingly, this disclosure should not be read as being limited only to the foregoing exemplary embodiment.

What is claimed is:

1. A method of adjusting an envelope comprising the steps of:

A) forming an envelope comprising the steps of:

1) providing an envelope blank comprising a front panel, a first side flap secured to said front panel, a second side flap secured to said front panel opposite said first side panel, a rear panel secured to said front panel and at least some portion of said second side flap, a closure panel secured to said front panel opposite said rear panel and at least some portion of said second side flap;

2) folding said first side flap and said second side flap to cover a portion of said front panel;

3) securing an adhesive to at least some portion of said closure flap and said first side flap;

4) securing said rear panel to said first side flap; and 5) folding said closure flap over a portion of said first side flap, said second side flap, and said rear panel to form said envelope; and B) adjusting said envelope comprising the steps of:

unfolding said closure flap to expose said second side flap;

unfolding said second side flap so that it fully extends from said front panel;

folding said second side flap along a new fold line at least some distance from said front panel;

tucking said second side flap underneath said rear panel;

inserting any contents into said envelope; and securing said closure flap to said rear panel.

2. The method of claim 1 wherein said first side flap, said second side flap, said rear panel, and said closure panel are secured to said front panel along a fold line.

3. The method of claim 1 wherein said first side flap has at least one adhesive region.

4. The method of claim 1 wherein said closure flap has at least one adhesive region.

5. The method of claim 2 wherein said second side flap has at least one fold line at least some distance from said front panel fold line.

6. The method of claim 1 wherein said side flaps, rear panel, front panel, and closure panel are dimensioned to provide a secure envelope.

7. A method of adjusting an envelope comprising the steps of:

A) forming an envelope comprising the steps of:

1) providing an envelope blank comprising a front panel, a first side flap secured to said front panel, a second side flap secured to said front panel opposite said first side panel, a rear panel secured to said front panel and at least some portion of said second side flap, a closure panel secured to said front panel opposite said rear panel and at least some portion of said second side flap;

2) folding said first side flap and said second side flap to cover a portion of said front panel;

3) securing an adhesive to at least some portion of said closure flap and said first side flap; and 4) securing said rear panel to said first side flap to form said envelope with said closure flap extended; and B) adjusting said envelope comprising the steps of:

1) unfolding said second side flap so that it extends from said front panel;

2) folding said second side flap along a new fold line at least some distance from said front panel;

3) tucking said second side flap underneath said rear panel;

4) inserting any contents into said envelope;

5) folding said closure flap over a portion of said first side flap, said second side flap, and said rear panel; and 6) securing said closure flap to said rear panel.

8. The method of claim 7 wherein said first side flap, said second side flap, said rear panel, and said closure panel are secured to said front panel along a fold line.

9. The method of claim 7 wherein said first side flap has at least one adhesive region.

10. The method of claim 7 wherein said closure flap has at least one adhesive region.

11. The method of claim 8 wherein said second side flap has at least one fold line at least some distance from said front panel fold line.

12. The method of claim 7 wherein said side flaps, rear panel, front panel, and closure panel are dimensioned to provide a secure envelope.

* * * * *